313-414 SR
12/23/86 OR 4,631,442

United States Patent [19]
Reule et al.

[11] Patent Number: 4,631,442
[45] Date of Patent: Dec. 23, 1986

[54] TEMPERATURE COMPENSATED ELECTRON GUN SYSTEM

[75] Inventors: Hans Reule, Wendlingen; Hartmut Ganzle, Plochingen, both of Fed. Rep. of Germany

[73] Assignee: International Standard Electric Corporation, New York, N.Y.

[21] Appl. No.: 653,753

[22] Filed: Sep. 21, 1984

[30] Foreign Application Priority Data

Sep. 22, 1983 [DE] Fed. Rep. of Germany ..... 3334242

[51] Int. Cl.[4] ..... H01J 29/50; H01J 29/82
[52] U.S. Cl. ..... 313/414; 313/417; 313/457
[58] Field of Search ..... 313/414, 458, 460, 417, 313/451, 457

[56] References Cited

U.S. PATENT DOCUMENTS 4,138,624 2/1979 Srowig ..... 313/417
4,331,904 5/1982 Johanns et al. ..... 313/417
4,492,894 1/1985 Reule et al. ..... 313/417 X

*Primary Examiner*—David K. Moore
*Assistant Examiner*—K. Wieder
*Attorney, Agent, or Firm*—Donald J. Lenkszus

[57] ABSTRACT

An electron-gun system is described in which the segments of the particularly long electrode neighboring the other electrodes are made of a material having a temperature expansion coefficient differing from that of the other electrodes.

18 Claims, 3 Drawing Figures

TEMPERATURE COMPENSATED ELECTRON GUN SYSTEM

BACKGROUND OF THE INVENTION

The present invention relates to an electron-gun system for multi-cathode-ray tubes, such as color picture tubes. More specifically, the invntion pertains to a system comprising cathodes and several electrodes following them and lying behind each other in the electron-beam direction, of which at least one electrode has a substantially greater spatial extension in the electron beam direction than the other electrodes, and comprises at least two segments, with the electrodes being made of different materials.

One such electron-gun system is known from German OS No. 2,920,151.

In this conventional electron-gun system, at least the first three electrodes when looked at in the beam direction, are made of different materials. The temperature expansion coefficients of the materials of the electrodes are staggered increasingly from the cathode to the screen in such a way that the distance variations in the beam direction between the apertures of the electrodes lying next to each other, and through which the electron beams are permitted to pass, decrease linearly when the electron-gun system is at operating temperature.

By taking this measure the voltages occurring in the electron-gun system due to it being heated up to high temperatures (ranging between 91° to 315° C.), remain as low as possible. Furthermore, the electron-optical lenses existing between the electrodes can have an undisturbed effect upon the electron beams.

These conventional types of electron-gun systems have proved well in practice. The pictures produced by the electron beams in a color picture tube, however, should not only be convergent in the operating state of the color picture tube but also shortly after the color picture tube is put into operation. In a color picture tube, the warming-up time may last several minutes. It has been observed that during this warming-up time of the color picture tube there appear very noticeable misconvergencies.

These misconvergenices are due to the fact that during the warming-up time of the color picture tube, because of different expansion velocities of the materials, there appears a temporarily occurring displacement between the electrodes G3 and G4. This leads to a distortion of the electron-optical lens between G3 and G4.

It was found that in the case of an "inline" electron-gun system comprising "unitized guns", in which the corresponding electrodes of all three electron beams are united in one body, this displacement between one electrode aperture in the electrode G3 of an electron beam lying outside, and the corresponding electrode aperture in the electrode G4 in the case of a center spacing of the electrode apertures of 6.6 mm, amounts to about 1.5 $\mu$m. This causes the displacement of the phosphor dot energized by an electron beam passing through these apertures, in the center of the screen of a 27" tube, with respect to the neighboring phosphor dot by about 0.2 mm in the case of a voltage of 18 kV between the electrodes G3 and G4. The displacement of the phosphor dots as produced by the two outer electron beams of a color picture tube in relation to one another, that is of the red and the blue phosphor dots, will then amount to about 0.4 mm in the center of the screen. This is a clearly visible misconvergence.

Any possibly remaining residual misconvergence in the steady-state condition of the color picture tube, that is, when the electron-gun system thereof has reached its operating temperature can be corrected in the conventional way with the aid of a convergence unit. However, a color picture tube may take up to thirty minutes to reach its operating temperature and this misconvergence during the warming-up period is undesireable.

SUMMARY OF THE INVENTION

It is an object of the invention, to improve upon the conventional electron-gun system such that during the warming-up period, the possible misalignment between the electrodes is reduced, and that the amount of any misalignment lies below the interference limit.

According to the invention, this object is achieved in that the electrodes G2 and G4 neighboring the larger electrode G3, as well as the segments of the larger electrode G3 neighboring these electrodes, are made of materials having different temperature expansion coefficients. The material of the electrode segment neighboring the electrode G4, has a smaller temperature expansion coefficient than the material of the electrode G4. The material of the electrode segment neighboring the electrode G2 has either a larger temperature expansion coefficient than the material of the electrode G2, or the same expansion coefficient.

In an electron-gun system in accordance with the invention, a smaller misalignment results between the electrodes during the warming-up period, and/or the period of time in which a misconvergence occurs due to the misalignment is shorter than with conventional types of electron-gun systems, so that the necessary convergence correction is smaller and can be carried out substantially earlier.

BRIEF DESCRIPTION OF THE DRAWINGS

The invention will now be explained hereinafter with reference to the accompanying drawings, in which.

DETAILED DESCRIPTION

Figure 1:
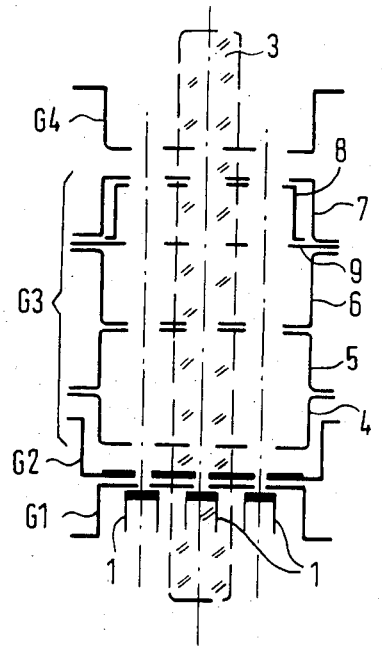
FIG. 1 shows a "unitized" electron-gun system schematically in a longitudinal section taken along the greater axis of the rectangle.
Figure 2:
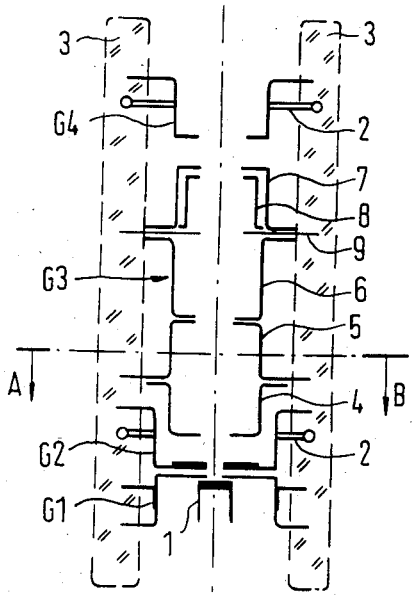
FIG. 2 shows the electron-gun system of FIG. 1 in a sectional view taken along the smaller axis of the rectangle.
Figure 3:
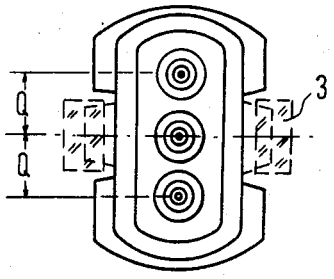
FIG. 3 is the cross-sectional view of the electron-gun system of FIG. 1, taken along the line A—B of FIG. 2.

FIGS. 1 to 3 show a so-called "unitized" electron-gun system for use with a so-called "incline" color picture tube. One such electron-gun system, as is clearly recognizable from FIG. 3, has an almost rectangular cross-section and contains the electron-gun systems which are parallel to one another on one line and which are each intended to excite the red, the green and the blue phosphor dots on the screen of the color picture tube.

The electron-gun system comprises three individual cathodes 1 as well as the electrodes G1, G2, G3 and G4. The electrodes consist either of individual (G1, G2 and G4) or else of several composite, pot-shaped metal bodies each provided with a rim portion, which are sealed into the glass rods 3 either at their rim portions or on additional hold members 2 connected to the electrodes or segments. The electrode G3 has the greatest length of all of the electrodes and is composed of the electrode segments 4, 5, 6 and 7. Moreover, within the electrode segments 6 and 7 there are provided further electrode segments 8 and 9. The electrode segments forming the electrode G3 are connected to one another either non-positively and/or in a form-fit connection. As a rule, the connection is effected by way of spot welding.

As can be seen from the drawings, the electrodes are provided with apertures through which the electron beams are coming from cathodes 1, are permitted to pass on their way to the screen. The apertures in the same electrode or in the same electrode segment are arranged in one line next to each other and at equally spaced relations as can be seen from FIG. 3. This spaced relation at room temperature is indicated by the letter Q. The apertures of the various electrodes have different diameters; however, they are arranged concentrically in relation to a common axis of symmetry. Since the electrodes, during operation of the color picture tube, have different electric potentials, electron-optical lenses are formed between them which influence the path taken by the electron beams.

The invention is concerned with the variation of the electron-optical lenses caused by the different expansions of the electrodes during the warming-up period of the electron-gun system to the operating temperature, which lead to the aforementioned misconvergencies.

By way of example, conventional color television picture tubes have a filament power of about 4.4 watt, and in the operating condition the cathodes have a temperature of about 760° C. The electrode G2 has a temperature of about 150° C., the electrode segment 4 has a temperature of about 100° C., the electrode segment 7 has a temperature of about 85° C., and the electrode G4 has a temperature of about 70° C.

The convergence errors during the warming-up period of the color picture tube can be very considerably reduced when the electrodes G4 and G2, as well as the electrode segments 7 and 4 are made, in accordance with the invention, of different materials. For this purpose there are used materials which, at the operating temperatures ranging between 20° and 150° C., have temperature expansion coefficients ranging between $1.0\times10^{-5°}$ C.$^{-1}$ and $1.7\times10^{-5°}$ C.$^{-1}$.

A suitable material having the temperature expansion coefficient $1.7\times10^{-5°}$ C.$^{-1}$ is an austenitic nickel-chromium steel containing 16 to 20 wt. percent of cr, 8 to 12 wt. percent of Ni, and the rest iron. This material is not ferromagnetic at room temperature. For those electrodes or electrode segments which are made of a material having the higher temperature expansion coefficient, the material may be chosen from a number of austenitic steels whose temperature expansion coefficient ranges between 1.7 and $1.9\times10^{-5°}$ C.$^{-1}$.

A material having the temperature expansion coefficient $1.5\times10^{-5°}$ C.$^{-1}$ for the electrode G2 and the electrode segment 7 can, for example, be a nickel-chrome-iron alloy containing of not less than 52 wt present of Ni, 14 to 21 wt. percent of Cr and a maximum of 10 wt. percent of Fe. However, alloys also may be used which contain about 80 wt. percent Ni and about 20 wt. percent of Cr or whose composition consists of about 65 wt. percent of Ni, about 30 wt. percent of CR and a maximum of 1 wt. percent of Fe. These alloys are likewise not ferromagnetic at room temperature. For the electrode G2 it is also possible to use materials which are ferromagnetic at room temperature, such as an alloy consisting of 48 to 54 wt. percent of Ni, a maximum of 2 wt. percent of Cr and the rest Fe, or with about 72 wt. percent of Fe and about 28 wt. percent of Cr.

When the electrode segment 7 is made of a material containing 80 wt. percent of Ni and 20 wt. percent of Cr, then the electrode segments 4, 5 and 6 can be made of an austenitic nickel chromium steel.

In case individual electrode segments are designed to consist of several parts for example, the part of the electrode G3 consisting of the electrode segments 7, 8 and 9, it is of advantage for all electrode segments to consist of the same material. It is possible, however, that only slight deviations result when the electrode segments 8 and 9 are made of a material having a temperature expansion coefficient slightly differing from that of the electrode segment 7. Thus, for example, the electrode segment 7 can be made of a material containing more than 72 wt. percent of Ni, 14 to 21 wt. percent of Cr and more than 10 wt. percent of Fe, and the electrode segments 8 and 9 can be made of an austenitic nickel-chromium steel.

What is claimed is:

1. An electron-gun system for multi-cathode-ray tubes comprising:

one or more cathodes; and at least second, third and fourth electrodes following said one or more cathodes and arranged one behind each other in the electron beam direction;

said third electrode having a substantially larger spatial expansion in said electron beam direction than said second and fourth electrodes and comprising at least a first electrode segment neighboring said second electrode and a second electrode segment neighboring said fourth electrode;

said second and fourth electrodes and said first and second electrode segments each consisting of materials having different temperature expansion coefficients, said second electrode segment consisting of a material having a smaller temperature expansion coefficient than the material of said fourth electrode, said first electrode segment consisting of a material having a temperature expansion coefficient either larger than or the same as that of the material of said second electrode.

2. An electron-gun system in accordance with claim 1, wherein:

said third electrode comprises at least one inner electrode segment consisting of a material having a temperature expansion coefficient lying between those of said first and second electrode segments.

3. An electron-gun system in accordance with claim 1, wherein:

said third electrode comprises two inner electrode segments disposed between said first and second electrode segments, said two inner electrode segments consisting of a material having a temperature expansion coefficient the same as the material of said first electrode segment.

4. An electron-gun system in accordance with clam 3, wherein:

the temperature expansion coefficient of said fourth electrode is at least 10 percent greater than that of said electrode segment.

5. An electron-gun system in accordance with claim 4, wherein:

at least said second electrode segment and said fourth electrode each consist of a material which is not ferromagnetic at room temperature.

6. An electron-gun system in accordance with claim 5, wherein:

the material of said fourth electrode has a temperature expansion coefficient of about $1.7\times10^{-5°}$ C.$^{-1}$, and that the material of said second electrode has a temperature expansion coefficient no greater than $1.5\times10^{-5°}$ C.$^{-1}$.

7. An electron-gun syste in accordance with claim 6, wherein:

the materials of said fourth electrode and said first electrode segment are an austenitic chromium nickel steel alloy.

8. An electron-gun system in accordance with claim 7, wherein:

the material of said second electrode and of said electrode segment is a nickel-chromium iron alloy.

9. An electron-gun system in accordance with claim 1, wherein:

the material of said second electrode consists of an alloy selected from the group of nickel-chromium-iron alloy, chromium-iron alloy or nickel-iron alloy.

10. An electron-gun system in accordance with claim 2, wherein:

the material of said second electrode consists of an alloy selected from the group of nickel-chromium-iron alloy, chromium-iron alloy or nickel-iron alloy.

11. An electron-gun system in accordance with claim 3, wherein:

the material of said second electrode consists of an alloy selected from the group of nickel-chromium-iron alloy, chromium-iron alloy or nickel-iron alloy.

12. An electron-gun system in accordance with claim 4, wherein:

the material of said second electrode consists of an alloy selected from the group of nickel-chromium-iron alloy, chromium-iron alloy or nickel-iron alloy.

13. An electron-gun system in accordance with claim 5, wherein:

the material of said second electrode consists of an alloy selected from the group of nickel-chromium-iron alloy, chromium-iron alloy or nickel-iron alloy.

14. An electron-gun system in accordance with claim 6, wherein:

the material of said second electrode consists of an alloy selected from the group of nickel-chromium-iron alloy, chromium-iron alloy or nickel-iron alloy.

15. An electron-gun system in accordance with claim 7, wherein:

the material of said second electrode consists of an alloy selected from the group of nickel-chromium-iron alloy, chromium-iron alloy or nickel-iron alloy.

16. An electron-gun system in accordance with claim 8, wherein:

the material of said second electrode consists of an alloy selected from the group of nickel-chromium-iron alloy, chromium-iron alloy or nickel-iron alloy.

17. An electron-gun system in accordance with claim 2, comprising:

constituent parts arranged within or on at least one of said first or second electrode segments, said constituent parts consisting at least partially of a material having the same temperature expansion coefficient as said at least one electrode segment.

18. An electron-gun system in accordance with claim 17, wherein:

said constituent parts consist of an austenitic chromium-nickel-iron alloy.

* * * * *